US006205299B1

(12) United States Patent
Kusaka et al.

(10) Patent No.: US 6,205,299 B1
(45) Date of Patent: Mar. 20, 2001

(54) IMAGE FORMING APPARATUS IN WHICH WHETHER TRANSFER MEMBER SHOULD BE CONSTANT-CURRENT-CONTROLLED OR CONSTANT-VOLTAGE-CONTROLLED IS SELECTED DEPENDING ON THICKNESS OF TRANSFER MATERIAL

(75) Inventors: Kensaku Kusaka, Moriya; Satoshi Tomiki, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/523,950

(22) Filed: Mar. 13, 2000

(30) Foreign Application Priority Data

Mar. 17, 1999 (JP) ..... 11-071565

(51) Int. Cl.[7] ..... G03G 15/16
(52) U.S. Cl. ..... 399/45; 399/66
(58) Field of Search ..... 399/44, 45, 66, 399/138, 313

(56) References Cited

U.S. PATENT DOCUMENTS 5,450,180 * 9/1995 Ohzeki et al. ..... 399/313
5,455,664 * 10/1995 Ito et al. ..... 399/50
5,809,367 * 9/1998 Yoo et al. ..... 399/66
5,822,651 * 10/1998 Yim et al. ..... 399/66
5,893,661 * 4/1999 Sakai et al. ..... 399/66

* cited by examiner

*Primary Examiner*—Joan Pendegrass
(74) *Attorney, Agent, or Firm*—Fitzpatrick, Cella, Harper & Scinto

(57) ABSTRACT

The present invention relates to an image forming apparatus in which current control means constant-current-controls a current value flowing in a transfer member so as to become constant, voltage control means constant-voltage-controls a voltage value applied to the transfer member so as to become constant, and selecting means selects a control of the transfer member during transfer to constant current control or constant voltage control in conformity with the thickness of the transfer material.

6 Claims, 6 Drawing Sheets

IMAGE FORMING APPARATUS IN WHICH WHETHER TRANSFER MEMBER SHOULD BE CONSTANT-CURRENT-CONTROLLED OR CONSTANT-VOLTAGE-CONTROLLED IS SELECTED DEPENDING ON THICKNESS OF TRANSFER MATERIAL

BACKGROUND OF THE INVENTION

1. Field of the Invention

This invention relates to an image forming apparatus such as a copier or a printer using the electrophotographic process or the electrophotographic recording process, and particularly to an image forming apparatus using the contact transfer process.

2. Related Background Art

An image forming apparatus of the transfer type in which a transferable image of image information which is generally a toner image is formed by a suitable image forming process and is borne on the surface of an image bearing member, the transferable image is transferred to a transfer material such as paper, the image is fixed, the transfer material is outputted as an image forming material (a copy or a print) and the image bearing member is repetitively used for image formation has been widely put into practical use.

FIG. 8 of the accompanying drawings is a schematic construction model view of a typical example of such an image forming apparatus of the transfer type. This example of the image forming apparatus is a copier or a printer utilizing the transfer type electrophotographic process.

The reference numeral 10 designates a drum type electrophotographic photosensitive member (hereinafter referred to as the photosensitive drum) as an image bearing member, and it is rotatively driven at a predetermined peripheral speed (process speed) in the clockwise direction of arrow X, and the image forming process of charging, image exposing, developing, transferring and cleaning is applied to this photosensitive drum.

That is, the rotatively driven photosensitive drum 10 has its surface uniformly charged to a predetermined polarity and potential by a primary charger 11.

The charged surface is then subjected to image exposure 12 by image exposing means (such as an original image projecting and exposing device or an image modulated laser beam scanning and exposing device), not shown, as image information writing means, whereby the charging potential of an exposed light portion is attenuated and an electrostatic latent image corresponding to exposed image information is formed on the surface of the photosensitive drum.

The electrostatic latent image is sequentially made into a visible image as a transferable toner image (visualized image) in a developing region A by a developing device 13.

The toner image is transferred to a transfer material (transfer paper) 18 in a transfer region T by transfer means.

The transfer means in the present example is transfer means of the contact transfer type using a roller-shaped contact transfer charger 16 (hereinafter referred to as the transfer roller).

The transfer roller 16 comprises, for example, a mandrel and an elastic layer of medium resistance formed around the mandrel, and is urged against the photosensitive drum 10 with a predetermined pressure force against the elasticity of the elastic layer to thereby form a transfer region T (a transfer nip portion), and is rotated at substantially the same peripheral speed as the rotational peripheral speed of the photosensitive drum in a forward direction relative to the rotation of the photosensitive drum 10.

The transfer material 18 is fed from a feeding means portion, not shown, and is timed by registration rollers 15 disposed on this side of the transfer region T and is fed to the transfer region T.

That is, the registration rollers 15 feed the transfer material 18 to the transfer region T so that the leading end portion of the transfer material 18 may just come to the transfer region T when the leading end portion of the toner image area formed on the surface of the rotating photosensitive drum 10 comes to the transfer region T.

The transferred material 18 fed to the transfer region T is pinched and conveyed through the transfer region T with its surface being in close contact with the rotating photosensitive drum 10. Also, during the time from after the leading end portion of the transfer material 18 has come to the transfer region T until the trailing end portion thereof leaves the transfer region T, a predetermined transfer bias is applied from a transfer bias voltage source 20 to the mandrel of the transfer roller 16.

In the process in which the transfer material 18 is pinched and conveyed through the transfer region T, the toner image on the rotating photosensitive drum 10 is sequentially transferred to the transfer material 18 by the action of a transfer electric field formed by the transfer roller 16 as a contact transfer charger and a pressure force in the transfer region T.

The transfer material 18, when it leaves the transfer region T, is separated from the surface of the rotating photosensitive drum 10 and is conveyed to an image fixing device, not shown, and the transferred toner image is fixed as a permanent image on the surface of the transfer material, and the transfer material is discharged as an image forming material (a copy or a print).

The surface of the photosensitive drum 10 after the separation of the transfer material is cleaned by a cleaner 17 with any residual toner and other contaminants such as paper powder thereon removed, and is repetitively used for image formation.

As the image forming methods, there are, for example, a normal (regular) developing method of exposing the charged surface of the photosensitive member corresponding to the background portion of image information (a background exposing method), and developing the portion other than the background portion, and a reversal developing method of exposing the charged surface of the photosensitive member corresponding to the image information portion (an image exposing method), and developing a non-exposed portion, and these methods are used so as to make the most of their respective features.

Transfer means of the contact transfer type using the contact transfer charger typified by the transfer roller 16 as described is popular as transfer means for transferring the toner image as a transferable image on the photosensitive drum 10 as an image bearing member onto the transfer material 18 such as paper, and as compared with transfer means using a corona charger of the non-contact type, this has merits such as the small capacity of the power source and the small amount of production of a discharge product typified by ozone.

Now, when use is made of the transfer means of the contact transfer type as previously described, there are known two methods, i.e., a "constant current control" method of setting a transfer current to a predetermined value, and a "constant voltage control" method of setting a transfer voltage to a predetermined value.

In the case of the constant current control method, however, when a thick and small-sized transfer material such as a postcard or an envelope is supplied, the transfer current is liable to flow to a non-paper supply area from the difference in resistance between a paper supply area and the non-paper supply area during paper supply, and the amount of transfer charges imparted to the back of the transfer material becomes small, and bad transfer such as transfer void is liable to occur. This phenomenon is more remarkable as the volume resistance of the transfer roller 16 which is a contact charger is smaller and therefore, it can be improved by making the volume resistance of the transfer roller higher, but there arise such problems as the higher voltage of the power source and transfer leak.

In contrast with this, in the case of the constant voltage control method, there are not the problems as noted above, but yet there are the following problems.

That is, this method is liable to be affected by the unevenness of the resistance value of the transfer roller 16. In order to prevent this, use has heretofore been made of a method called ATVC (Active Transfer Voltage Control: Japanese Patent Application Laid-open No. 2-123385) in which a predetermined constant current is applied to the transfer roller before image formation, and the resistance value of the transfer roller is judged from the then power source output voltage to thereby determine a constant voltage control value.

However, when particularly thin and large-sized paper is used, as compared with the case where the aforedescribed constant current control method is used with respect to the unevenness of the amount of transfer current imparted to the back of the transfer material, the case where the constant voltage control method is used is apparently inferior.

As described above, the constant current control method and the constant voltage control method have their own merits and demerits. In order to solve this, Japanese Patent Application Laid-open No. 9-297476 proposes a method of selecting one of constant current control and constant voltage control in conformity with environmental conditions.

Also, Japanese Patent Application Laid-open No. 8-114989 proposes a method of effecting constant current control when the resistance value of the transfer roller is higher than a reference value, and effecting constant voltage control when the resistance value of the transfer roller is lower than the reference value.

However, even these prior-art methods still leave the following problems to be solved.

That is, even when the thickness of the transfer material was changed, the constant current control or the constant voltage control was selected depending on the environmental conditions and the resistance value of the transfer roller, and depending on the thickness of the transfer material used, the transfer charges of the back of the transfer material became deficient to cause transfer void, or conversely the transfer voltage was too strong and memory was sometimes produced in the photosensitive drum as an image bearing member.

Particularly, in a method of forming a toner image on the surface of a photosensitive member holding potential of the same polarity as that of the toner which is typified by reversal development, the transfer polarity during transfer is opposite to the polarity of the surface of the photosensitive member, and as compared with the normal developing method, drum memory was liable to be produced.

SUMMARY OF THE INVENTION

It is an object of the present invention to provide an image forming apparatus which can effect good transfer to transfer materials of various thickness.

It is another object of the present invention to provide an image forming apparatus comprising:

an image bearing member bearing a toner image thereon;

a transfer member cooperating with the image bearing member to form a nip for pinching a transfer material, and transferring the toner image on the image bearing member to the transfer material;

current control means for constant-current-controlling a current value flowing in the transfer member so as to become constant;

voltage control means for constant-voltage-controlling a voltage value applied to the transfer member so as to become constant, and selecting means for selecting a control of the transfer member during transfer to constant current control or constant voltage control in conformity with the thickness of the transfer material.

Other objects of the present invention will become apparent from the following description.

DESCRIPTION OF THE PREFERRED EMBODIMENTS

Some embodiments of the present invention will hereinafter be described with reference to the drawings.

Figure 1:
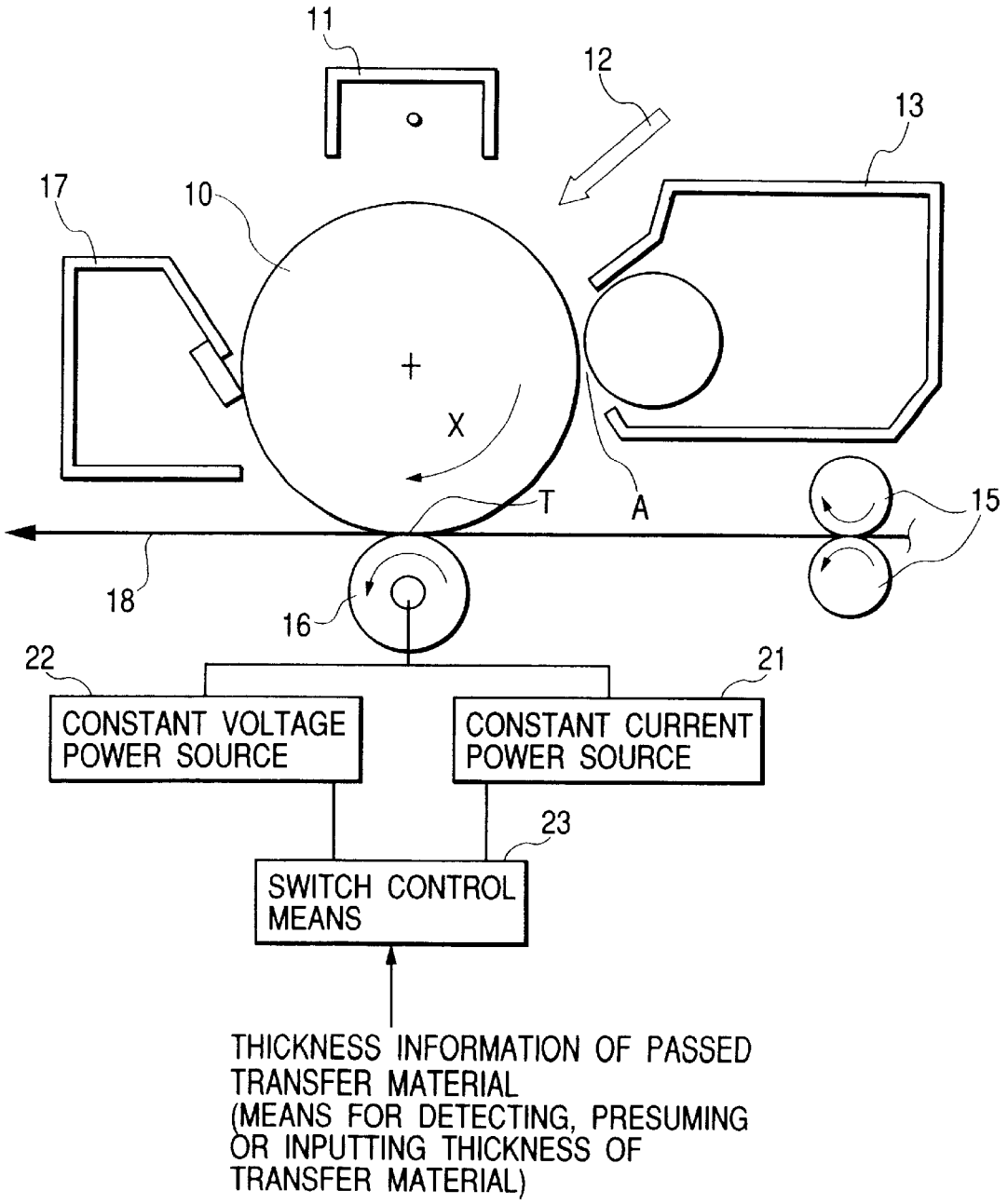
FIG. 1 is a schematic construction model view of an image forming apparatus according to a first embodiment of the present invention.

First Embodiment (FIG. 1)

Figure 8:
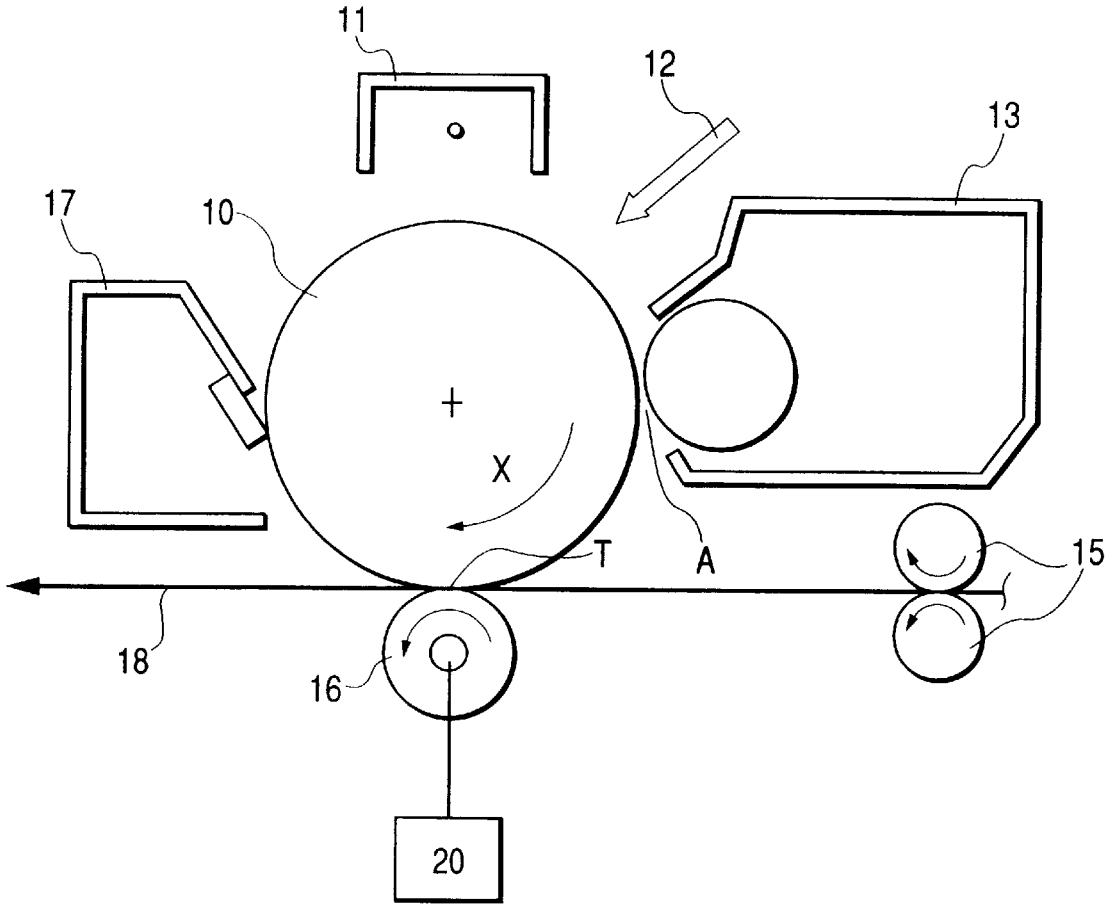
FIG. 8 is a schematic construction model view of an example of a conventional image forming apparatus.

FIG. 1 is a schematic construction model view of an image forming apparatus according to the present embodiment. The construction of the image forming apparatus according to the present embodiment is substantially similar to that of the aforedescribed image forming apparatus of FIG. 8 and therefore, common constituent parts are given the same reference numerals and need not be described again.

In the image forming apparatus according to the present embodiment, the polarity of the charging process of a photosensitive drum 10 which is an image bearing member by a primary charger 11 is minus.

The toner development of an electrostatic latent image formed on the surface of the photosensitive drum 10 by a developing device 13 is a reversal developing method using a toner of the minus polarity (negative toner).

The polarity of a transfer bias is plus.

The passing speed of a transfer material is 105 mm/s.

The maximum size of the passed transfer material is A4 width (297 mm), and the minimum size of the passed transfer material is postcard length (corresponding to 105 mm).

The length of a transfer roller 16 as a contact transfer charger is 315 mm.

The reference numerals 21, 22 and 23 designate a constant current power source, a constant voltage power source and transfer switch control means (switch control means), respectively, for the transfer roller 16.

One of the constant current control and constant voltage control of transfer means is selected by the transfer switch control means 23, and during the passing of the transfer material (transfer paper) 18 at a transfer region T, a transfer bias is applied from the constant current power source 21 (in the case of the constant current control) or the constant voltage power source 22 (in the case of the constant voltage control) to the transfer roller 16.

In the present embodiment, the selective switching of the constant current control or the constant voltage control of the transfer means by the transfer switch control means 23 is done in conformity with the thickness of the transfer material 18 passed through the apparatus. The input of the thickness of the transfer material 18 is a user's input, and on the basis of the input, the transfer switch control means 23 switches the output of the transfer bias to the transfer roller 16 to (1) the constant voltage control output by the constant voltage power source 22 when the thickness of the transfer material 18 is 120 g/m$^2$ or greater in terms of conversion to basis weight (about 150 $\mu$m or greater in terms of thickness), and (2) the constant current control output by the constant current power source 21 when the thickness of the transfer material 18 is less than 120 g/m$^2$ in terms of conversion to basis weight (less than about 150 $\mu$m in terms of thickness).

During the constant current control, output control was effected at a control value of 9 $\mu$A.

The constant voltage control was such that during the non-passing of the transfer material, a voltage applied to the transfer roller 16 during a constant current of 9 $\mu$A was measured, and on the basis of the detected voltage value, the constant voltage value during the passing of the transfer material was determined and output control (ATVC control) was effected.

By adopting the construction of the present embodiment, good transferability was obtained both in the case of the passing of thick transfer materials of 120 g/m$^2$ or greater and in the case of the passing of thin transfer materials of less than 120 g/m$^2$.

While in the present embodiment, the thickness of the transfer material is inputted by the user, this is not restrictive, but for example, on the basis of the result of the detection of the thickness of a passed transfer material from such conventional paper thickness detecting means as measures a variation in the electrostatic capacity between a pair of electrically conducting rollers with the transfer material pinched between the rollers, the selective switching of the constant current control or constant voltage control of the transfer means by the transfer switch control means 23 may be effected.

Of course, the maximum size and minimum size of the passed transfer material in the image forming apparatus, the length of the transfer roller, the reference width, etc. of the transfer material for the selective switching of the constant current control and constant voltage control are not restricted to those in the present embodiment. For example, from the volume resistance value or the like of the transfer roller 16 used, the paper thickness for the selective switching of the constant current control and constant voltage control may be changed, and the switching of the control may be effected, for example, by a transfer material of a particular thickness such as a postcard or an envelope typical as thick paper.

Also, while in the present embodiment, the passing speed of the transfer material in the image forming apparatus is 105 mm/s, the constant current control value is 9 $\mu$A and the constant voltage control is ATVC control, of course this is not restrictive.

As described above, in the transfer roller system, constant current control in the case of a thin transfer material and constant voltage control in the case of a thick transfer material are executed, whereby in the case of a thin transfer material, in an inconvenience of transfer wherein there is generally current dependency (transfer charge amount dependency), the optimum control is effected, and in the case of a thick transfer material, substantially optimum transfer charges can be imparted by the constant voltage control, and satisfactory transfer can be effected to a transfer material of any thickness. That is, an improvement in the accuracy of the transfer control in the transfer roller system and the coping with transfer materials of various thicknesses become possible.

Figure 2:
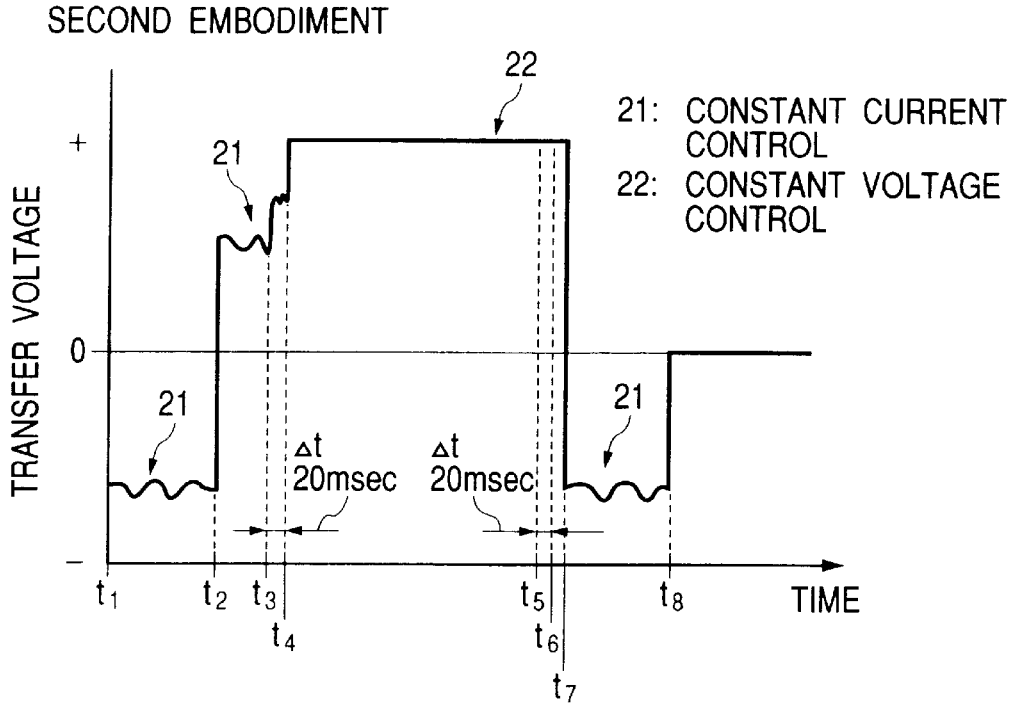
FIG. 2 is a graph showing the control of the power supply to transfer means in a second embodiment of the present invention.

Second Embodiment (FIG. 2)

The construction of an image forming apparatus according to this embodiment is the same as that of the apparatus according to the first embodiment.

In the present embodiment, the control of the power supply to the transfer means when the transfer material 18 is paper of a thickness of 250 $\mu$m (paper of 200 g/m$^2$ in terms of the conversion to basis weight) will be described with reference to FIG. 2.

FIG. 2 is a graph showing variations with time in the applied voltage to the transfer roller 16 in the present embodiment.

1) When at a time $t_1$, the user inputs an image forming start signal to the image forming apparatus and the image forming operation is started, a constant current value (−5 $\mu$A) having the minus polarity opposite to the polarity during transfer is applied to the transfer roller 16, and the residual toner on the transfer roller 16 is returned to the photosensitive drum 10 (transfer roller cleaning).

2) Thereafter, at a time $t_2$ before the transfer material 18 arrives at the transfer region T, a constant current (+5 $\mu$A) of the same polarity as that during transfer is applied.

This current value is smaller than the current value applied to the transfer material 18 during the transfer of the toner image thereto, and does not adversely affect the photosensitive drum 10.

3) Thereafter, at a time $t_3$, the leading end edge of the transfer material 18 arrives at the transfer region T.

4) At a time $t_4$ later by $\Delta t$ (about 20 msec.) than it, such a constant voltage value of which the current value becomes about 9 $\mu$A begins to be supplied.

The time from the time $t_3$ until the time $t_4$ is a non-image area in which the toner is not printed on the transfer material 18 and therefore, it poses no problem to the quality of image that the transfer current is deficient during this time.

5) Thereafter, at a time $T_6$, the transfer material 18 leaves the transfer region T. A time $t_5$ is a time earlier by Δt (about 20 msec.) than when the trailing end of the transfer material 18 leaves the transfer region T.

6) Thereafter, at a slightly later time $t_7$, a minus constant current (−5 μA) is supplied to the transfer roller 16, and the residual toner on the transfer roller 16 is returned to the photosensitive drum (transfer roller cleaning).

When in the present embodiment, use is made of paper of which the basis weight is less than 120 g/m$^2$ (e.g. a transfer material of basis weight 60 g/m$^2$ and a thickness 80 μm), constant current control is effected by the switch control means 23 for power supply control while and before and after the transfer material 18 passes through the transfer region T.

Therefore, of course, there is not produced the memory of the photosensitive drum 10 in the non-passing area of the leading and trailing ends of the transfer material 18.

As an effect peculiar to the present embodiment, when thick paper is used, the voltage applied to the transfer roller 16 is held down to a low level until the transfer material 18 arrives at the transfer region T. Therefore, the memory of the photosensitive drum 10 can be reduced and particularly, the uniformity of a halftone image is improved.

Figure 3:
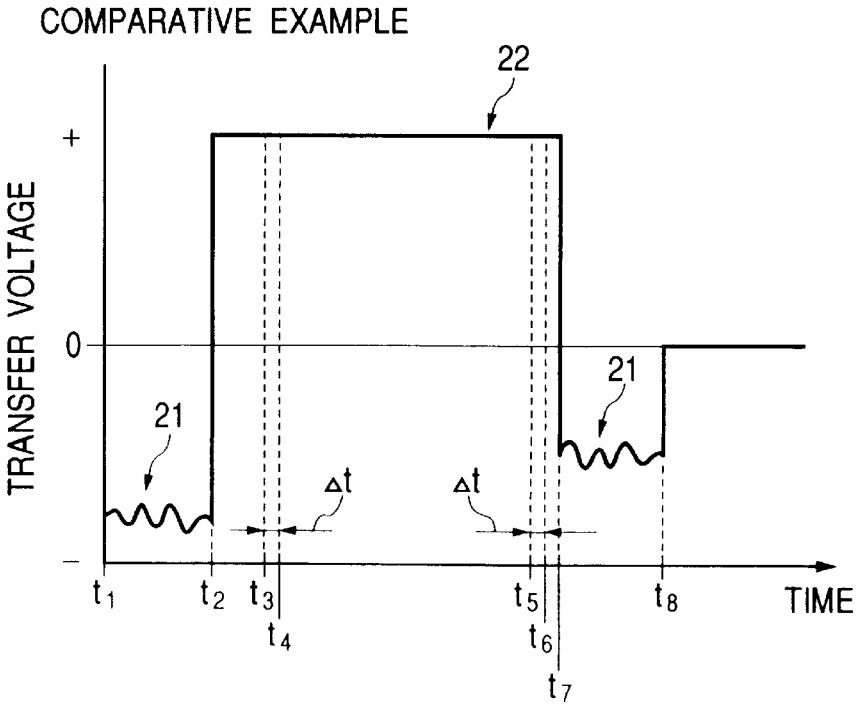
FIG. 3 is a graph showing the control of the power supply to transfer means in a comparative example.

Comparative Example (FIG. 3)

A comparative example to the above-described second embodiment will now be described. FIG. 3 is a graph showing variations with time in the applied voltage to the transfer roller 16 in this comparative example.

As a difference from the second embodiment, in the present comparative example, a constant voltage is abruptly applied at a time $t_2$. As the result, during the time $t_2$ until a time $t_4$, a high voltage as compared with that in the second embodiment is applied to the transfer roller 16. Therefore, a memory is produced in the photosensitive drum 10 which is in contact with the transfer roller 16, and unevenness occurs to a halftone image.

Figure 4:
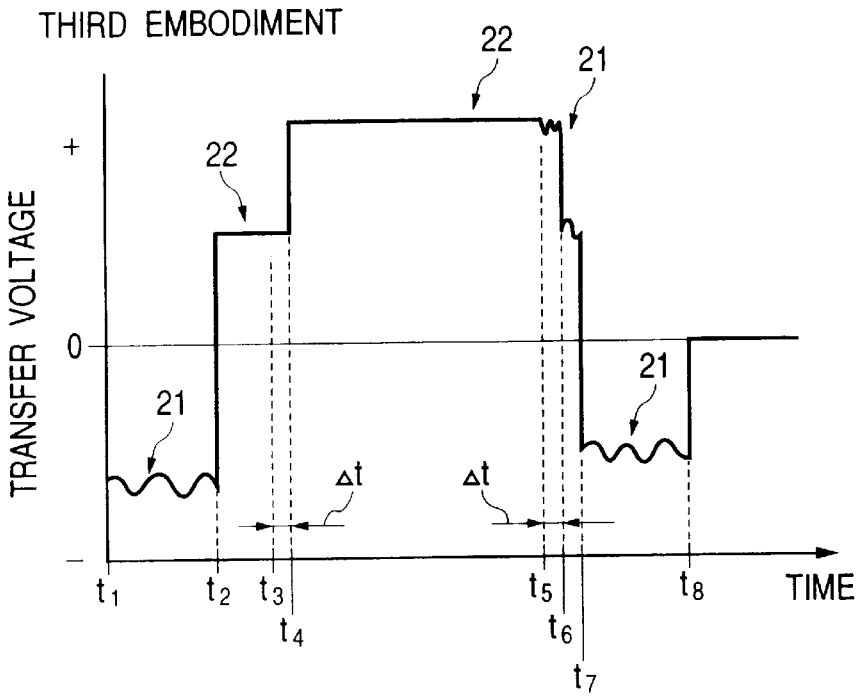
FIG. 4 is a graph showing the control of the power supply to transfer means in a third embodiment of the present invention.

Third Embodiment (FIG. 4)

In the present embodiment, the construction of the image forming apparatus is the same as that of the apparatus according to the first embodiment.

Again in the present embodiment, the control of the power supply to the transfer means when the thickness of the transfer material 18 is 200 g/m$^2$ will be described with reference to FIG. 4.

FIG. 4 is a graph showing variations with time in the applied voltage to the transfer roller 16 in the present embodiment.

1) When at a time $t_1$, the user inputs an image forming start signal to the image forming apparatus and the image forming operation is started, a constant current value (−5 μA) having the minus polarity which is the polarity opposite to that during transfer is applied to the transfer roller 16, and the residual toner on the transfer roller 16 is returned to the photosensitive drum 10 (transfer roller cleaning).

2) Thereafter, at a time $t_2$ before the leading end edge of the transfer material 18 arrives at the transfer region T, a constant voltage of a half value of that during transfer is applied with the same polarity as that during transfer.

3) Thereafter, at a time $t_3$, the leading end edge of the transfer material 18 arrives at the transfer region T, and at a time $t_4$ later by Δt (about 20 msec.) from it, such a constant voltage value that the current value becomes about 9 μA begins to be supplied.

The time from the time $t_3$ till the time $t_4$ is a non-image area in which the toner is not printed on the transfer material 18 and therefore, it poses no problem to the quality of image that the transfer current is deficient during this time.

4) Thereafter, at a time $t_5$ earlier by Δt (about 20 msec.) than the trailing end of the transfer material 18 leaves the transfer region T, a constant current value (+5 μA) is applied.

5) Thereafter, at a time $t_6$, the transfer material 18 leaves the transfer region T. The time from the time $t_5$ till the time $t_6$ is a non-image area in which the toner is not printed on the transfer material 18 and therefore, it poses no problem to the quality of image that the transfer current is deficient during this time.

6) Thereafter, at a time $t_7$, a minus constant current (−5 μA) is supplied to the transfer roller 16, and the residual toner on the transfer roller 16 is returned to the photosensitive drum (transfer roller cleaning).

As an effect peculiar to the present embodiment, the memory of the photosensitive drum 10 at the end of the transfer step can be reduced and therefore, the uniformity of image when a plurality of transferring operations are performed on end is further improved.

Figure 5:
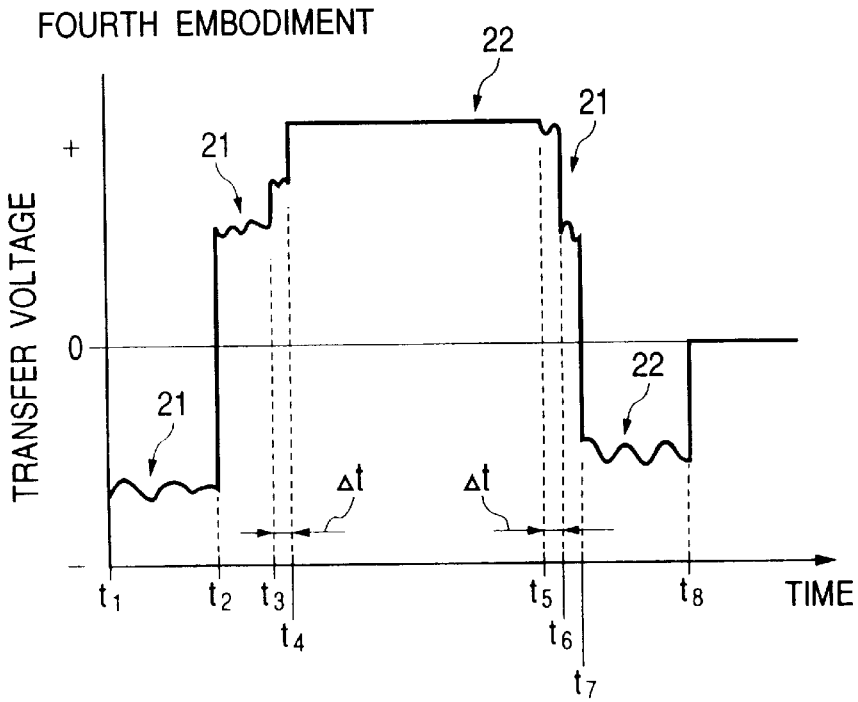
FIG. 5 is a graph showing the control of the power supply to transfer means in a fourth embodiment of the present in invention.

Fourth Embodiment (FIG. 5)

Even when the second embodiment and the third embodiment are combined and thick paper is used, only the substantially non-image area of the leading and trailing ends of the transfer material may be controlled to such a predetermined constant current that becomes a degree of voltage which does not produce the drum memory.

FIG. 5 shows the control of the power supply to the transfer means in the present embodiment. The description of the times is the same as that in the second to third embodiments.

According to the present embodiment, the memory of the photosensitive drum can be prevented at both of the leading and trailing ends of the transfer material, and the image becomes more uniform.

Figure 6:
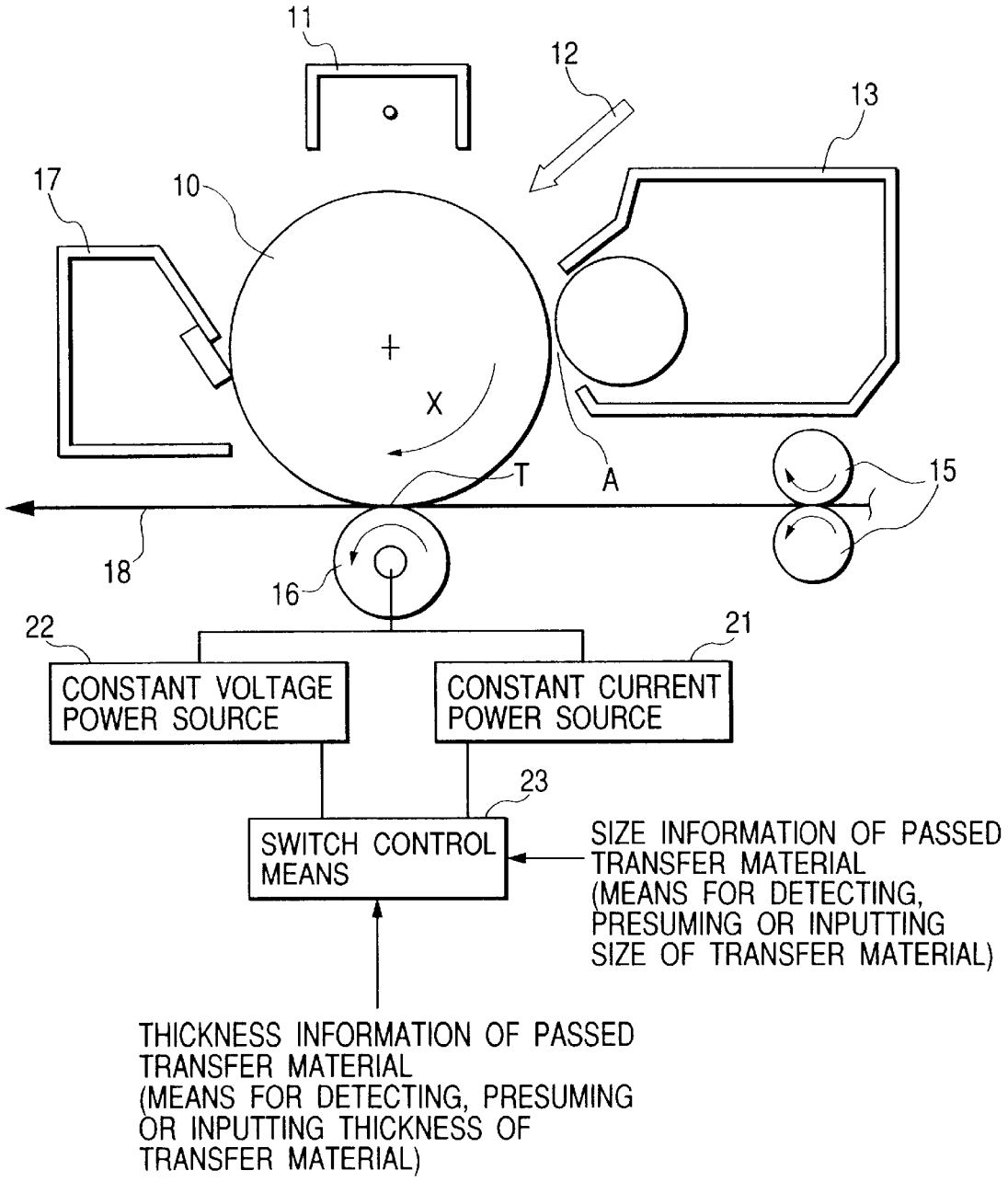
FIG. 6 is a schematic construction model view of an image forming apparatus according to a fifth embodiment of the present invention.
Figure 7:
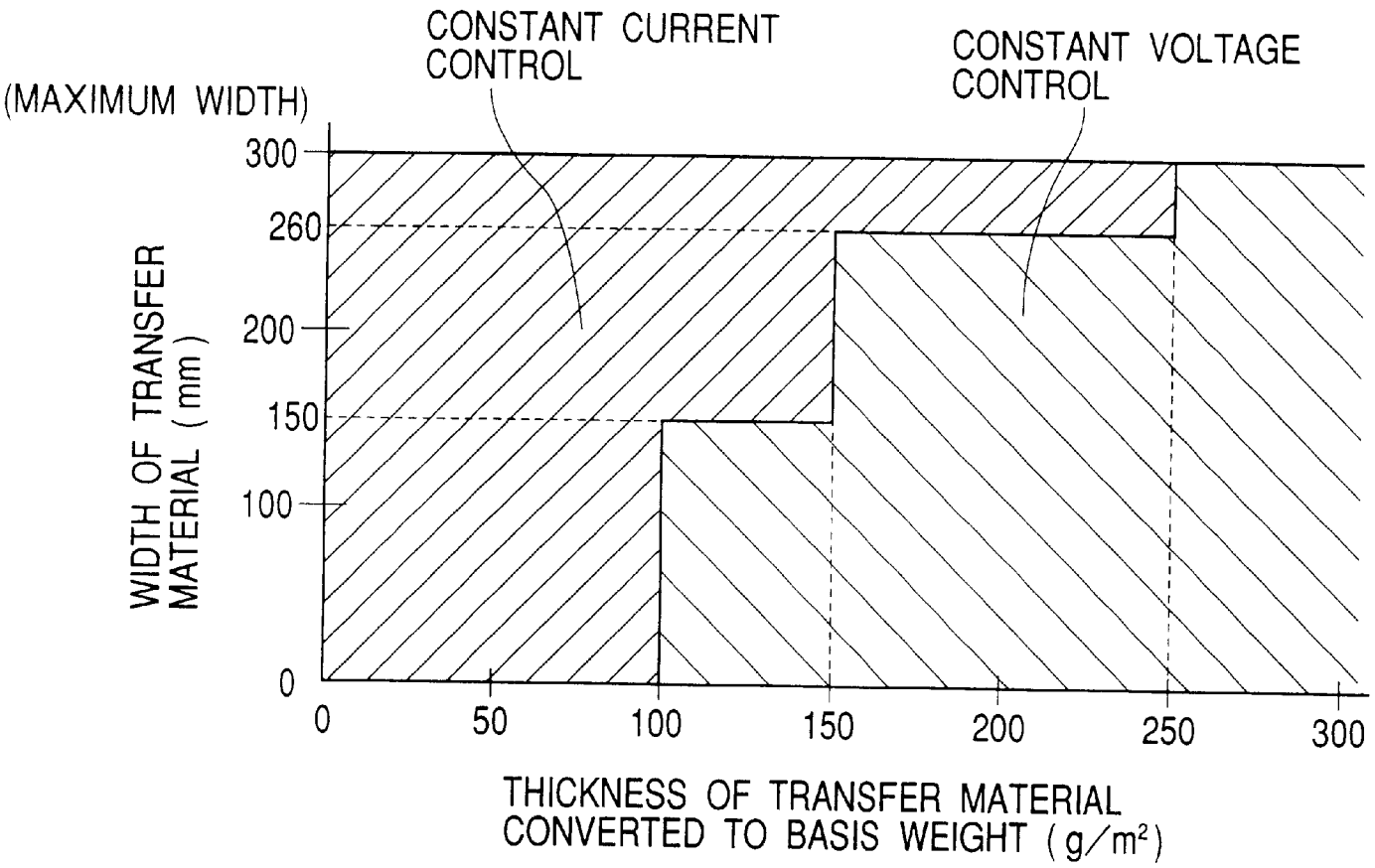
FIG. 7 is a switch table of constant current control and constant voltage control.

Fifth Embodiment (FIGS. 6 and 7)

FIG. 6 is a schematic construction model view of an image forming apparatus according to this embodiment. The construction of the image forming apparatus according to the present embodiment is substantially similar to that of the aforedescribed image forming apparatus of FIG. 1 according to the first embodiment and therefore, common constituent parts are given the same reference numerals and need not be described again.

As a difference from the image forming apparatus according to the first embodiment, in the present embodiment, the selective switching of the constant current control or constant voltage control of the transfer means by the transfer switch control means 23 is done in conformity with the thickness and size of the transfer material 18 passed through the apparatus.

The thickness (in the present embodiment, the basis weight as the substitute value thereof) and passing size of the transfer material 18 are inputted by the user, and on the basis of the input, the transfer switch control means 23 switches the output of a transfer bias to the transfer roller 16 as shown in the graph of FIG. 7.

FIG. 7 is a table showing which of constant current control and constant voltage control is selected by the inputted basis weight and width of the transfer material. This table is set in the transfer switch control means (control circuit) 23, and the transfer switch control means 23 selects one of the constant current control and the constant voltage control by the inputted basis weight and width (size) of the transfer material 18 in accordance with this table.

(1) That is, when the basis weight is less than 100 g/m$^2$, the constant current control is selected irrespective of the width of the transfer material.

(2) When the basis weight is 100 g/m$^2$ or greater and less than 150 g/m$^2$, the constant current control is selected for a width of 150 mm or greater, and the constant voltage control is selected for a width less than 150 mm.

(3) When the basis weight is 150 g/m$^2$ or greater and less than 250 g/m$^2$, the constant current control is selected for a width of 260 mm or greater, and the constant voltage control is selected for a width less than 260 mm.

(4) When the basis weight is 250 g/m$^2$ or greater, the constant voltage control is selected irrespective of the width of the transfer material.

During the constant current control, output control was effected at a control value of 9 $\mu$A.

In the constant voltage control, the voltage applied to the transfer roller 16 during a constant current of 9 $\mu$A was measured during the non-passing of the transfer material, and on the basis of the detected voltage value, the constant voltage value during the passing of the transfer material was determined and output control (ATVC control) was effected.

By adopting the construction of the present embodiment, good transferability was obtained for any basis weight/width of the transfer material.

In the case of the present embodiment, as a further effect from the first embodiment, when the transfer material is large-sized paper having a width of 260 mm or greater, the constant current control becomes possible even within the range of basis weight of 150 to 250 g/m$^2$ belonging to very thick paper as a usually used transfer material. In the case of the first embodiment, when the basis weight of the transfer material was e.g. 200 g/m$^2$, the constant voltage control was always selected and therefore, when use was made of a transfer material of such a large size, the drum memory was somewhat produced on the leading and trailing ends of the transfer material. In contrast, in the present embodiment, the constant current control is effected even when the leading and trailing ends of the transfer material pass through the transfer region and therefore, the voltage applied to the photosensitive drum in the non-image area in the direction of advance is held down to a low level, and the drum memory is not produced.

Accordingly, images of better quality than in the first embodiment are obtained.

On the other hand, even in the case of a transfer material of 200 g/m$^2$, when the size thereof is as small as e.g. 100 mm, the constant voltage control is selected and some memory is produced, but there are obtained images practically free of problems.

Generally, the size of a transfer material of which the basis weight is very great is often a small size as typified by a postcard/envelope or index paper, but in such case, printing is often not done up to the end portion of the transfer material, and it can be said that there is no actual harm.

While in the present embodiment, the basis weight and size of the transfer material are inputted by the user, this is not restrictive, but the selective switching of the constant current control or constant voltage control of the transfer means by the transfer switch control means 23 may be effected on the basis of the result of the detection of the size of the passed transfer material from transfer material size detecting means such as a sensor. Of course, the maximum size and minimum size of the passed transfer material in the image forming apparatus, the length of the transfer roller, the transfer material reference width for the selective switching of the constant current control and the constant voltage control, etc. are not restricted to those in the present embodiment. For example, the transfer material reference width for the selective switching of the constant current control and the constant voltage control may be changed on the basis of the volume resistance value of the transfer roller used, and control switching may be done, for example, by a transfer material of a particular size such as a postcard or an envelope typifying small-sized paper.

Also, in the present embodiment, the transfer material passing speed of the image forming apparatus is 105 mm/s, the constant current control value is 9 $\mu$A and the constant voltage control is ATVC control, but of course, this is not restrictive.

Other Embodiments

1) The image bearing member 10 is not restricted to an electrophotographic photosensitive member, but may also be an electrostatic recording dielectric member, a magnetic recording magnetic member or the like, and the principle and process of forming a transferable image on those image bearing members are subject to designer whim.

Also, the image bearing member 10 is not restricted to the drum type, but may arbitrarily be of a belt type, a web type, a sheet type or the like.

2) The contact transfer charger 16 is not restricted to the roller type, but may arbitrarily be of a belt type, a combination of a belt and an electrode blade, or the like.

3) The transfer member may also be an intermediate transfer member such as an intermediate transfer drum or an intermediate transfer belt.

While the embodiments of the present invention have been described above, the present invention is not restricted to these embodiments, but all modifications within the technical idea of the present invention are possible.

What is claimed is:

1. An image forming apparatus comprising:

an image bearing member bearing a toner image thereon;

a transfer member cooperating with said image bearing member to form a nip for pinching a transfer material, and transferring the toner image on said image bearing member to the transfer material;

current control means for constant-current-controlling a current value flowing in said transfer member so as to become constant;

voltage control means for constant-voltage-controlling a voltage value applied to said transfer member so as to become constant; and selecting means for selecting a control of said transfer member during transfer to constant current control or constant voltage control in conformity with the thickness of the transfer material.

2. An image forming apparatus of claim 1, further comprising thickness detecting means for detecting the thickness of the transfer material, wherein said selecting means selects on the basis of an output of said thickness detecting means.

3. An image forming apparatus of claim 1, wherein an operator can input information regarding the thickness of the transfer material, and said selecting means selects on the basis of the inputted information.

4. An image forming apparatus of claim 1, wherein said selecting means selects on the basis of the thickness and size of the transfer material.

5. An image forming apparatus of claim 1, wherein when said selecting means selects the constant voltage control, it switches to the constant voltage control after having been under constant current control for a leading end portion of the transfer material.

6. An image forming apparatus of claim 1, wherein when said selecting means selects the constant voltage control, it switches from the constant voltage control to the constant current control on the trailing end portion of the transfer material.

* * * * *